United States Patent [19]

Todisco

[11] 4,425,782

[45] Jan. 17, 1984

[54] HAND-HELD SETTING TOOL AND METHOD FOR SETTING DEFORMABLE HEAD FASTENERS

[75] Inventor: Joseph Todisco, Woburn, Mass.

[73] Assignee: Marson Corporation, Chelsea, Mass.

[21] Appl. No.: 327,051

[22] Filed: Dec. 3, 1981

[51] Int. Cl.[3] ..... B21D 15/34

[52] U.S. Cl. ..... 72/391; 72/114

[58] Field of Search ..... 72/391, 114

[56] References Cited

U.S. PATENT DOCUMENTS

| | | | |
|---|---|---|---|
| 2,430,563 | 11/1947 | Gill | 72/391 |
| 2,507,740 | 5/1950 | Tincler | 72/391 |
| 3,646,800 | 3/1972 | Martin | 72/391 |
| 3,767,297 | 10/1973 | Martin | 72/391 |
| 3,842,649 | 10/1974 | Di Maio | 72/391 |
| 3,933,019 | 1/1976 | Underland | 72/114 |
| 4,037,448 | 7/1977 | Di Maio | 72/114 |
| 4,070,889 | 1/1978 | DeCaro | 72/114 |
| 4,140,000 | 2/1979 | Ehmann | 72/114 |
| 4,147,047 | 4/1979 | Fluester | 72/391 |
| 4,192,163 | 3/1980 | Martin | 72/391 |

FOREIGN PATENT DOCUMENTS 2433207 7/1974 Fed. Rep. of Germany .

*Primary Examiner*—Gene P. Crosby
*Attorney, Agent, or Firm*—Pennie & Edmonds

[57] ABSTRACT

A tool (10) for setting rivet nuts (45) in which the non-rotatable collet (23) moved by handles (11,12) and receives in threaded engagement the mandrel holder (29) so that the mandrel holder (29) is axially adjustable with respect to the collet (23). Mandrels (36) are readily inserted in, secured to and removed from the mandrel holder (29) so that a selected mandrel (36) can be used for each type of rivet to be set against selected anvils (18, 20 and 62). Tool (10) is adjustable in various ways to ease placing the rivet (45) on the mandrel (36), affecting adjustment of the position of the rivet nut (45) vis-a-vis the anvil (18, 20 and 62) for a proper and effective pulling stroke and adjusting the travel of the collet during the stroke.

12 Claims, 12 Drawing Figures

HAND-HELD SETTING TOOL AND METHOD FOR SETTING DEFORMABLE HEAD FASTENERS

DESCRIPTION

1. Technical Field

This invention relates to hand-held tools adaptable for setting a plurality of types of fasteners that have deformable heads through ready substitution of pulling units and associated mandrels and use of adjustment means for adjusting the stroke of the tool.

2. Background Art

Blind rivet hand setting tools are well-known (see U.S. Pat. No. 3,768,297 to Martin). Numerous hand tools for setting threaded rivet nuts have also been suggested including arrangements for employing a plurality of replacable mandrels in a single tool such as the tool of U.S. Pat. No. 4,140,000 to Ehmann. Techniques for varying the amount of deformation of the rivet nut and varying the stroke of plier-type setting tools have also been proposed (see U.S. Pat. No. 2,430,563 to Gill and U.S. Pat. No. 4,192,163 to Martin).

Strokes of such tool may also be varied by adjusting sleeves on the pulling element as shown in U.S. Pat. No. 3,933,019 to Underland. Other developments in such tools are found in U.S. Pat. No. 4,147,047 to Fluester. Since rivet bolt fasteners with their threaded stems are, like rivet nuts, screwed into tool mandrels to accomplish setting, tools similar to rivet nut setting tools have been used for setting rivet bolts.

The present invention provides a versatile tool for setting numerous types and sizes of fasteners having deformable heads using a single handle and housing with novel conversion and adjustment arrangements.

REFERENCE TO PRIOR APPLICATION

The present application is a continuation-in-part of applicant's application entitled "A Hand-Held Rivet Setting Tool and Method" filed Mar. 4, 1981 as a PCT case subsequently filed as U.S. patent application Ser. No. 440,233 on Nov. 4, 1982, now abandoned.

SUMMARY OF THE INVENTION

The present invention comprises a hand tool capable of using a plurality of tubular handle-powered pullers. One puller receives in its threaded bore a mandrel holder, in turn, capable of readily receiving and holding a plurality of mandrels, each mandrel designed and sized to set a particular threaded rivet nut or rivet bolt. This mandrel holder is axially adjustable with respect to the tubular puller so that the threaded fastener mounted on the mandrel may be selectively positioned prior to the beginning of the setting stroke. Adjustment of the mandrel holder permits easy withdrawal of the mandrel from the puller. A second puller, capable of ready substitution in the tool, pulls non-threaded stem fasteners.

The tool has a housing and handle design which permits facile conversion of the tool from a threaded puller for a blind rivet puller.

DETAILED DESCRIPTION OF A PREFERRED EMBODIMENT

Figure 1:
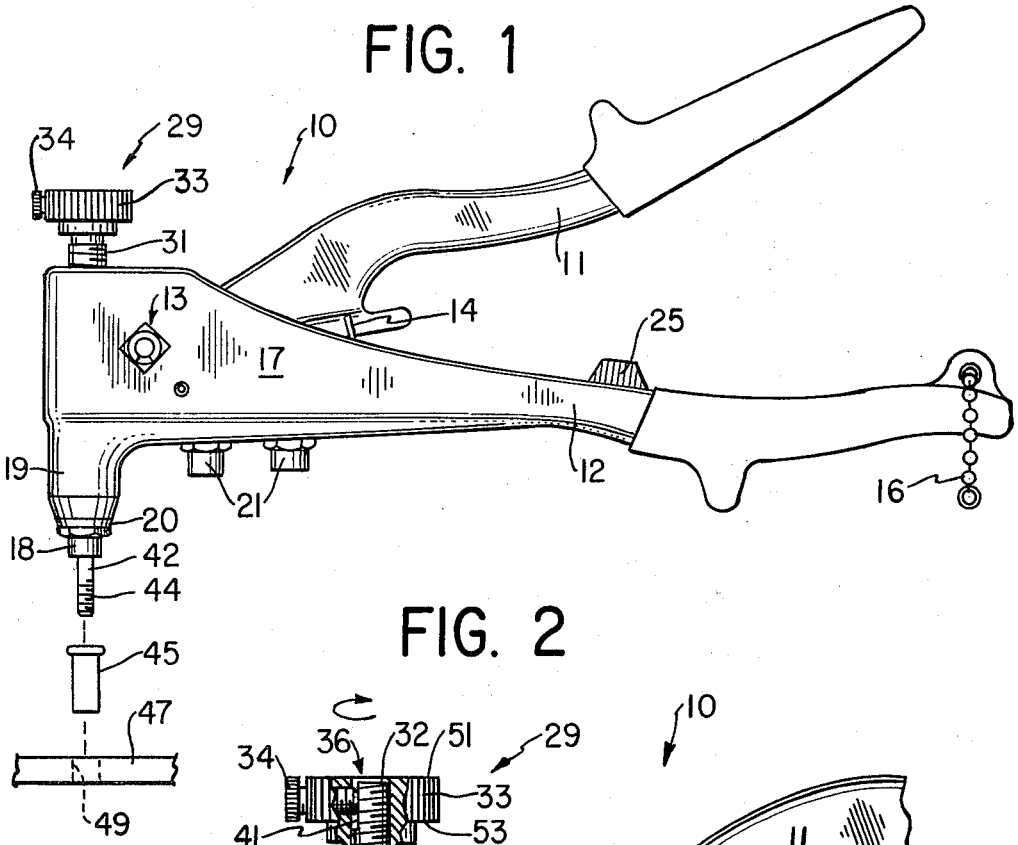
FIG. 1 is a side elevational view of the tool of this invention.
Figure 2:
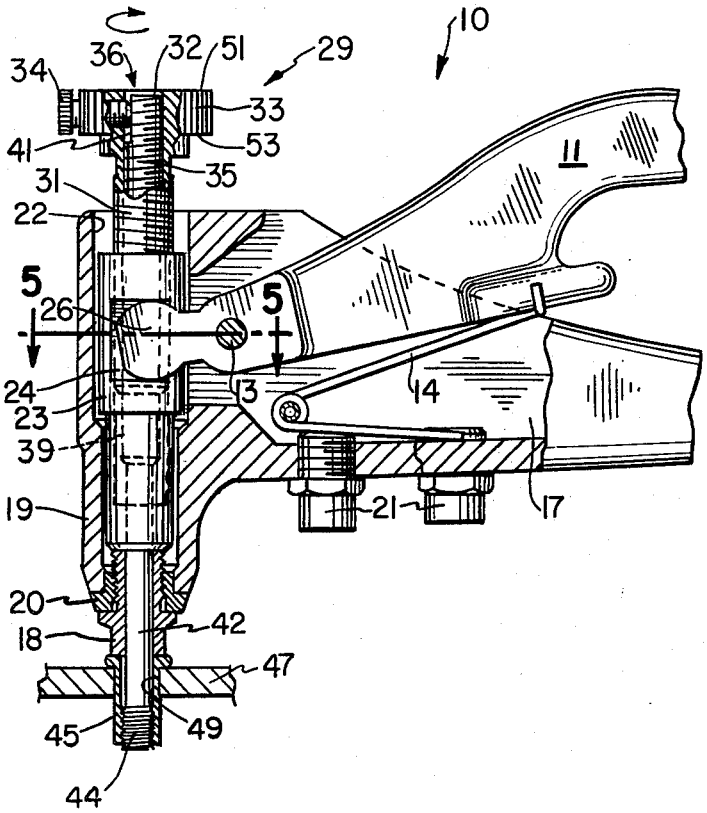
FIG. 2 is an enlarged partial sectional side elevational view of the tool showing the tool positioned to begin setting of the rivet nut.

Referring to FIGS. 1 and 2, tool 10 includes upper handle 11, lower handle 12, handle pivot bolt 13, and handle spring 14 which biases handles 11 and 12 apart. Loop chain 16 functions to hold the handles in a closed position with handle 11 brought adjacent stop 25. Housing 17 carries a spacer anvil 18 threaded into housing anvil 20 cast into housing nose piece 19. Extra spacer anvils 21 are screwed into the underside of housing 17. Anvils are required because housing 17 is not made of a material of sufficient hardness to withstand the forces or pressure created during setting of the rivet nut.

Turning to FIG. 2, housing cavity 22 is positioned and shaped so that internal parts can be readily substituted to convert housing 17 and handles 11 and 12 to other rivet setting uses as hereinafter described. Housing cavity 22 receives for rivet nut setting uses a reciprocating tubular collet 23. Tubular collet 23 has handle indentations 24 to opposite sides for engaging handle cam portions 26 to permit handle action to move collet 23 back and forth in cavity 22 (see also FIG. 5). The handles are fully opened when collet 23 hits bottom in cavity 22 or, in some uses, the top of anvil 18. The full range of movement of collet 23 is determined by the fully open and fully closed handle positions.

Collet 23 has a bore 27 passing throughout its length with portions having thereon internal threads 28 (shown in FIG. 3) for receiving in threaded engagement adjustable mandrel holder 29. Mandrel holder 29 has left hand threads 31 for threaded engagement with compatible threads 28 to collet bore 27. Mandrel holder 29 in turn has a threaded passageway 32, knurled adjusting knob 33 and locking screw 34.

Rivet nut pulling mandrel 36 with mandrel threads 35 is insertable from the bottom of the tool through housing nose 19, collet bore 27 and finally into mandrel-receiving passageway 32 for threaded engagement with mandrel holder threads (not shown). Mandrel 36 includes upper mandrel stem portion 39 having threads 35 and a flat-surface recess 41 for positioning the mandrel in and securing it to mandrel holder 29 using locking screw 34. Mandrel 36 also includes lower mandrel stem portion 42 for threaded engagment within rivet nut 45 using lower stem threads 44. To set rivet nuts of varying diameter and size, a plurality of mandrel 36 are used. Each has the same upper stem portion 39 to accommodate the mandrel holder 29 while the lower stem portions 42 are designed to fit the various rivet nuts contemplated to be set with the tool.

Figure 5:
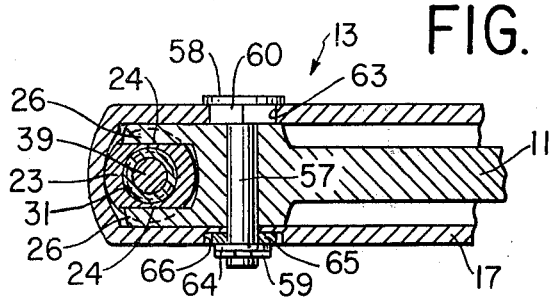
FIG. 5 is a sectional view along lines 5—5 of FIG. 2.

Referring further to FIGS. 2 and 5, tubular collet 23 is held against rotation in cavity 22 by handle cams 26. As shown, mandrel holder 29 engages the collet 23 using left hand threads. The clockwise direction, as used herein, is viewed from above the tool in FIG. 2 looking down at the tool. Therefore, with respect to FIG. 2, locking screw 34 would move toward the viewer as clockwise movement of adjustment knob 33 is begun. Such clockwise movement would cause adjustment knob 33 to move upwardly and out of collet 23. On the other hand, the mandrel 36 is secured to the mandrel holder 29 using right hand threads so that when the adjustment knob 33 is stationary clockwise rotation of the mandrel 36 causes mandrel 36 to move downwardly. If desired, mandrel holder 29 may engage collet 23 using the opposite (right hand) thread.

FIG. 5 shows pivot bolt 13 having integrally formed stem 57, outer head portion 58, and inner rectangular head portion 60. Inner head portion 60 fits in rectangular opening 63 in housing 17 to prevent turning of the bolt. Stem 57 passes through housing 17, a rectangular plate 65 in a second rectangular opening 66 and is secured at the end opposite head 58 with washer 64 and removable clip 59. Bolt 13 can be readily withdrawn, handle 11 pulled out and the substitution of internal parts affected for other uses of the tool housing, handles and pivot bolt combination.

Figure 6:
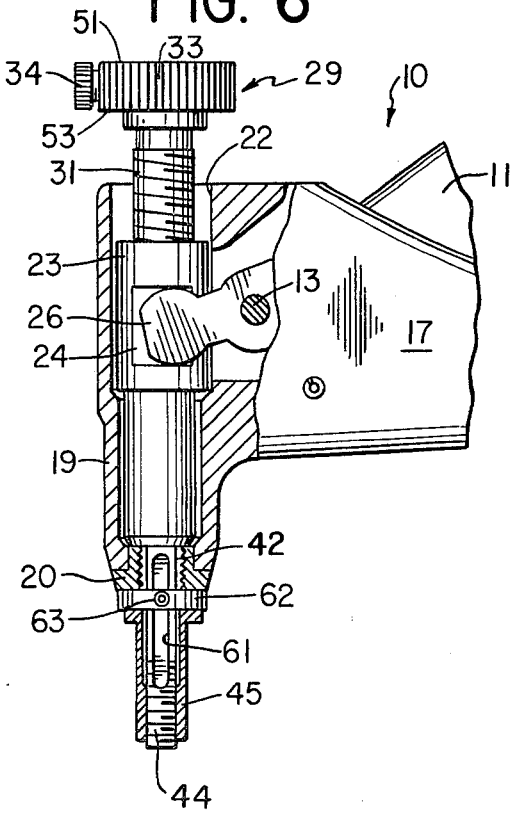
FIG. 6 is a modification of the invention in which the anvil is carried on the mandrel pulling stem.

FIG. 6 shows a modification of the tool of the invention in which a mandrel 36 carries longitudinal groove 61 on the side of lower stem portion 42. A floating ring anvil 62 surrounds stem portion 42. The travel of ring 62 along stem 42 is limited by a set screw 63 whose interior end rides in groove 61. Ring anvil 62, as positioned against housing anvil 20, serves as the anvil against which the rivet nut is pulled during setting.

Figure 7:
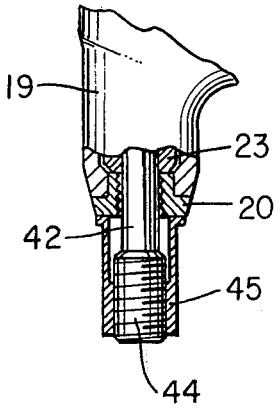
FIG. 7 is a modification in operation in which a spacer anvil is not used.

FIG. 7 shows the alternative use of the tool where rivet nut 45 is pulled directly against housing anvil 20 with no other anvil being used.

Before discussing the operation, it is contemplated that this tool will be used with a set of mandrels 36 having lower stems 42 of varying length and diameter for use with the various sizes and types of rivet nuts. Rivet nuts will be selected for use depending on thickness and nature of the workpiece 47 (which may involve a plurality of layers), the diameter of the workpiece aperture 49 and other considerations.

Figure 3:
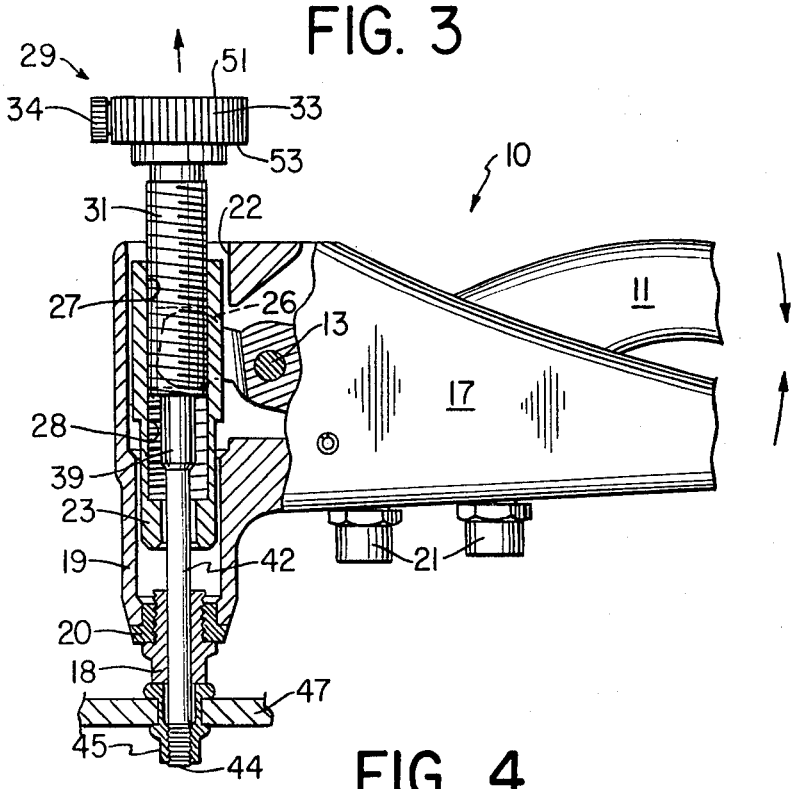
FIG. 3 is also a partial sectional elevational view showing the tool positioned after setting of the rivet nut.
Figure 4:
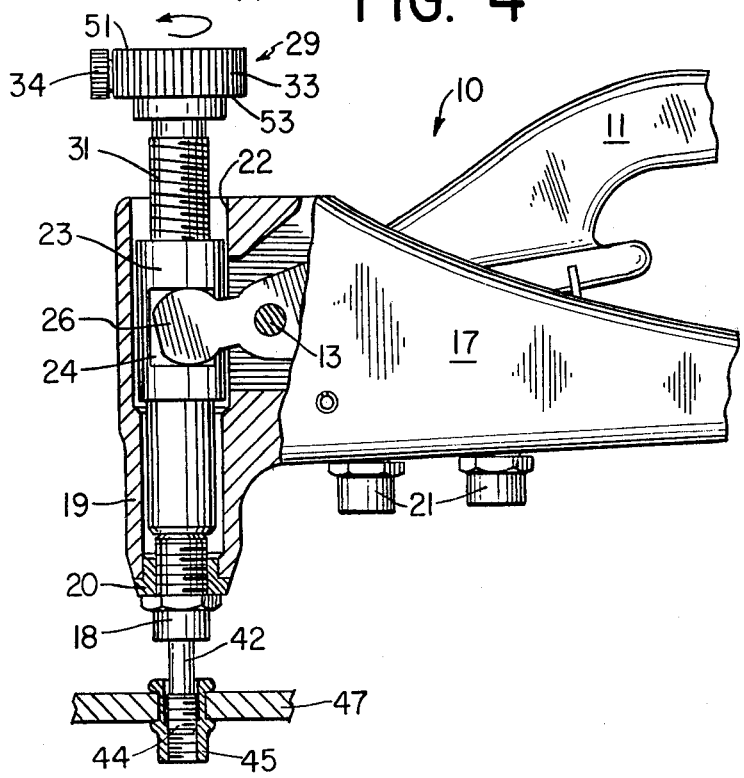
FIG. 4 is a partial sectional elevational view showing the tool being withdrawn from the rivet nut.

Turning to FIGS. 2, 3 and 4 and operation of the tool, the following sequence is preferred: Upon selecting the rivet nut to be set, the person operating the tool then selects the mandrel 36 designed for setting the selected rivet nut.

Next the tool handles are closed and preferably held together using loop chain 16. Adjustment knob 33 is turned counterclockwise (clockwise of a right thread is used) moving it toward tool housing 17 and, preferably until seating knob surface 53 comes against housing 17. The upper stem portion 39 of the selected mandrel 36 is threaded into mandrel holder 29 with the stem end flush with upper knob surface 51. The locking screw 34 is then turned to secure mandrel 36 and holder 29 together. A spacer anvil 21, selected from the anvils stored in threaded holes in the underside of housing 17, is then screwed into housing anvil 20. Spacer anvils 21 having differing diameter holes for use with the differing diameters of the lower stems 42 of mandrel 36.

The selected rivet nut is then screwed on flush with lower end of mandrel stem 42. Since adjustment knob 33 is down and has a left hand thread the knob 33 will not move during the screwing of the rivet nut on stem 42. After the rivet nut is on the stem, the adjustment knob 33 is then rotated clockwise until the rivet nut flange 54 contacts housing anvil 20, spacer anvil 18 or other anvils used. The tool handles are now released and the adjustment knob 33 further turned until the rivet nut flange 54 is again flushed against the anvil being used. If knob 33 has a right hand thread, the directions of movement are reversed.

The tool with the rivet nut on mandrel stem 42 is oriented to place the rivet nut in proper position in the workpiece 47 and, finally, the handles are pressed toward one another to set the rivet. If a tighter clinch is required, the handles are released slightly and knob 33 rotated clockwise (or counterclockwise) to move knob 33 with respect to housing 17 about one (1) turn. The handles are then clinched again for additional setting of the rivet.

After setting, knob 33 is rotated counterclockwise moving the knob 33 toward housing 17 and causing the mandrel 36 to rotate counterclockwise to withdraw it from the now stationary rivet nut in its set position.

The above operation provides a procedure whereby the pulling stroke is applied in the proper way for each selected rivet nut. Since the deformation of rivet nut is dependent on the application, as well as, the length of the pulling stroke, each nut is properly set using the present tool as described. The above operation may be varied to suit the convenience of the user. For example, adjustment knob 33 need not be initially adjusted down against the housing if the user wishes to hold knob 33 to prevent rotation during threading the rivet nut on the stem.

Figure 8:
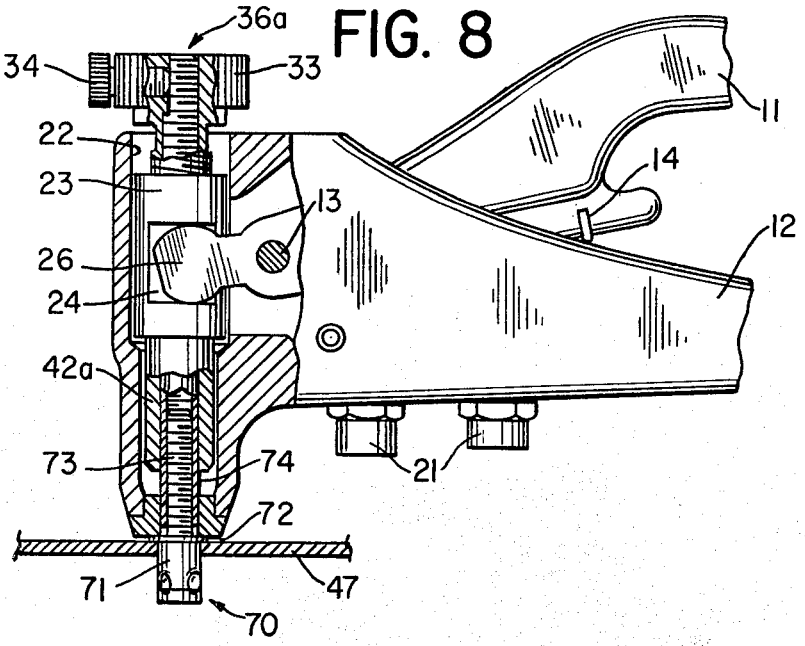
FIG. 8 is a side elevational view of the tool fitted with a mandrel for rivet bolts with the tool positioned to begin setting the bolt.
Figure 9:
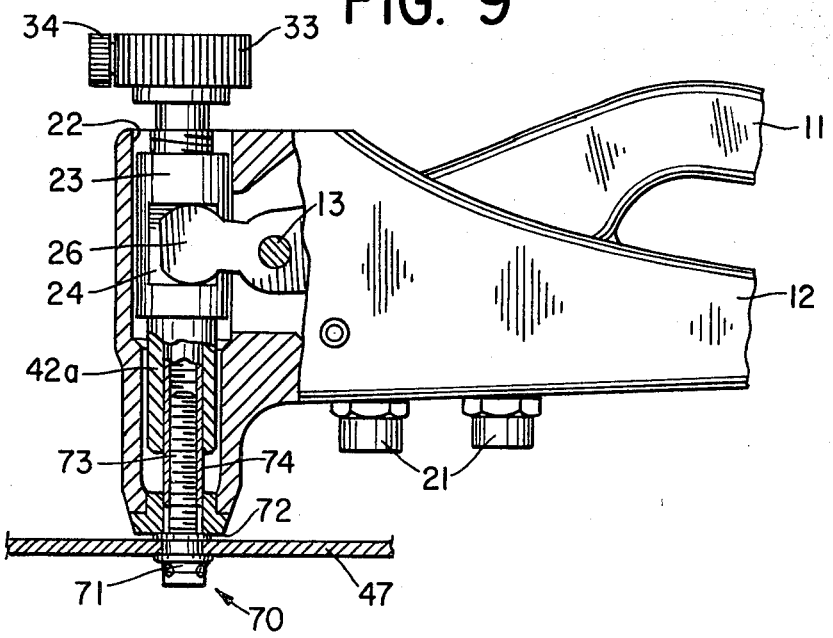
FIG. 9 is a view similar to FIG. 8 with the tool positioned after setting a rivet bolt.

Directing attention to FIGS. 8 and 9, tool 10 has been converted to set a rivet bolt 70 which comprises a head 71, a collar 72 and a threaded stem bolt 73. Mandrel **36*a* has a lower mandrel stem portion 42*a* with internal threads 74 to engage threaded stem bolt 73. Turning to FIG. 9, as handles 11 and 12 are moved together lower mandrel stem portion 42*a* moves upwardly pulling bolt 73 to set head 71 against work piece 47. The operation of the tool of FIGS. 8 and 9** is as follows.

With the tool 10 in the closed positon, screw adjusting knob 33 is turned counterclockwise to remove knob 33 completely from collet 23. A mandrel **36*a* with flattened recess 41 is inserted into the bottom of the knob 33 and the flattened recess 41 on the mandrel is in line with the mandrel locking screw 34. Locking screw 34 is tightened against recess 41 and the proper anvil 21 inserted into the tool. The screw adjusting knob 33 is then positioned for turning it clockwise a few turns back into collet 23. At this point a rivet bolt 70 is inserted into the bottom of the tool until it contacts the anvil 21. The adjusting knob 33 is now turned clockwise until it contacts the bolt 70** at which time the tool is opened.

Bolt 70 is then screwed into the mandrel stem portion **42*a* until it contacts anvil 21**. The tool is then ready for the setting operation.

Figure 10:
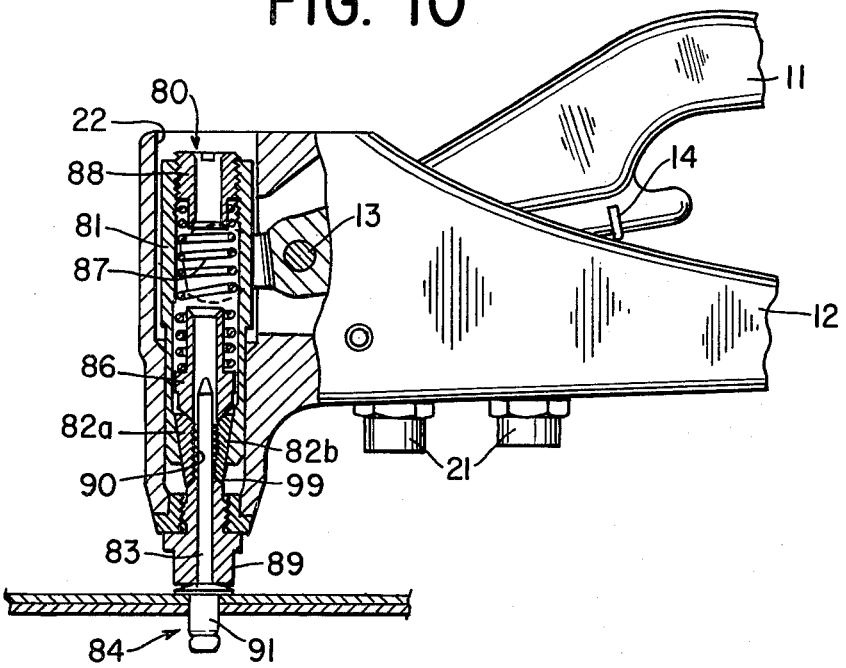
FIG. 10 is a side elevational view of the tool adapted to pull blind rivets with the tool positioned to begin pulling a blind rivet.
Figure 11:
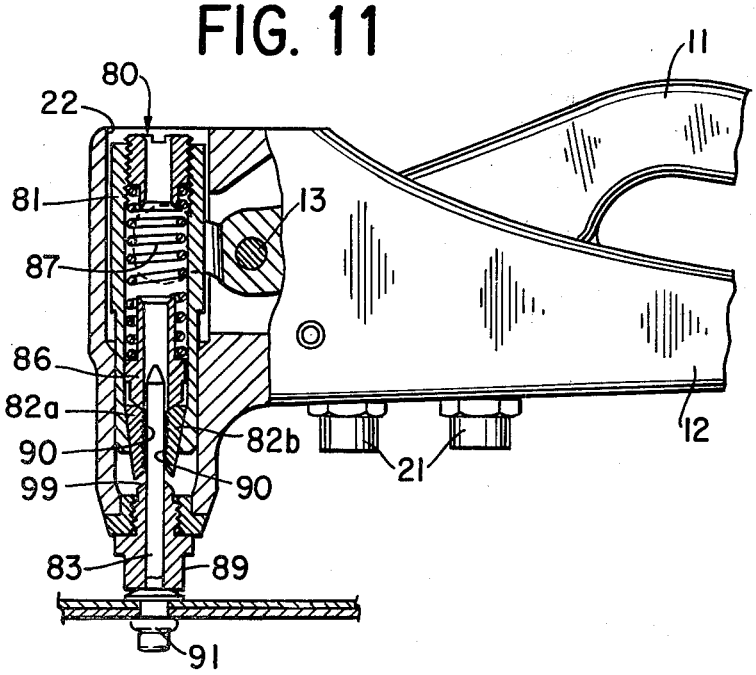
FIG. 11 is a view similar to FIG. 10 with the tool positioned during the pulling of the blind rivet.
Figure 12:
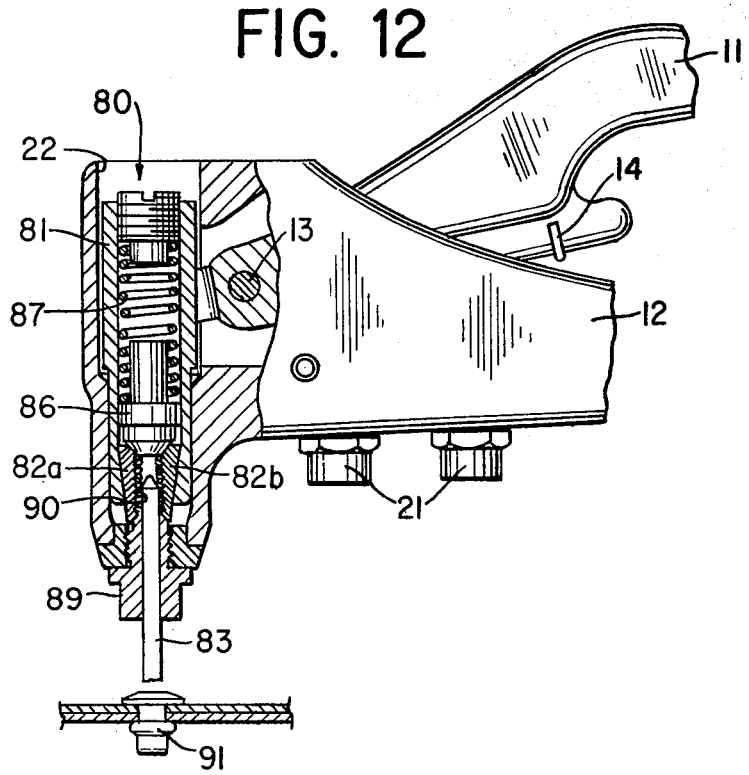
FIG. 12 is a view similar to FIG. 10 with the tool positioned after pulling the rivet to break its stem.

Further conversion of the tool is shown in FIGS. 10–12, in which collet 23 has been removed and replaced with a blind rivet puller unit 80 which, like collet 23, is slidable up and down in cavity 22 by action of the cam portions 26 of handle 11. Puller unit 80 carries cam portions 26a (dashed line) which ride in indentations 24 (not shown) to provide sliding engagment with cam portion 26a (see also FIG. 4).

Blind rivet puller unit 80 comprises housing 81, two (2) tapered jaws 82a, 82b for gripping stem 83 of the blind rivet 84 and jaw guide piece 86. Jaws 82a, 82b are urged downwardly against the tapered interior portion of housing 81 by jaw guide piece 86 through the force of coil spring 87. The tension of spring 87 is adjustable by rotating threaded adjustment cap 88. Jaws 82a, 82b have teeth 90 for gripping rivet stem 83 (see FIG. 12).

In operation the tool handles are opened to move puller unit 80 downward until jaws 82a, 82b engage nosepiece 89. Further downward movement of unit 80 spreads jaws 82a, 82b apart by action of cam surfaces 99 of nosepiece 89. As housing 81 of unit 80 continues to move downward, space available within housing 81 provides for jaw expansion. After stem 83 of blind rivet 84 is inserted between expanded jaws 82a, 82b, the handles are partially closed to grip stem 83 (see FIG. 10).

As the tool handles are then squeezed, puller unit 80 moves upwardly away from nosepiece 89 increasing the grip on stem 83 and causing stem 83 to elongate until rivet head 91 is formed and stem 83 fails in tension along break line 92 (FIG. 11). Turning to FIG. 12, the tool handles have in this figure been opened sufficiently to release broken stem 83 which has dropped clear of guide jaw piece 86 and is shown about to exit the tool.

I claim:

1. A hand-held tool adaptable for setting a plurality of types of headed fasteners each of which is set by pulling the fastener to deform the head comprising (a) a housing including an anvil;

(b) a cavity in the housing;

(c) first and second reciprocatable non-rotatable puller means for selective mounting in the cavity; each puller means capable of pulling at least one type of fastener;

(d) a first handle fixed to the housing;

(e) a second handle slidably engageable with each puller means and pivotably mounted on the housing to move each puller means reciprocally in the housing over a fixed range by manipulation of the handles toward and away from one another;

(f) the first puller means having an internal bore throughout the length of the puller means and a mandrel holder threadedly engageable in the bore of such puller means so that the mandrel holder is movable axially further in and axially further out of the puller means; such mandrel holder having a lower threaded stem portion extending from the cavity of the housing for threaded engagement with the fastener; and (g) the second puller means adapted to be substituted in the housing cavity for the first puller means; said second puller means having jaw means to releasably grip an unthreaded fastener stem.

2. A hand-held tool adapted for setting a plurality of fasteners each set by pulling a fastener stem to deform the head comprising (a) a housing including an anvil;

(b) a cavity in the housing;

(c) a plurality reciprocatable non-rotatable puller means for mounting in the cavity each puller means capable of pulling at least one type of fastener;

(d) a first handle fixed to the housing;

(e) a second handle slidably engageable with the puller means and pivotably mounted on the housing to move the puller means reciprocally in the housing over a fixed range by manipulation of the handles toward and away from one another;

(f) a first puller means having an internal bore throughout the length of the puller means; and (g) a mandrel holder threadedly engageable in the bore of such puller means so that the mandrel holder is movable axially further in and axially further out of the puller means; such mandrel holder having a lower threaded stem portion extending from the cavity of the housing for threaded engagement with the stem of a fastener;

whereby the distance between the anvil and the rivet nut may be varied by (1) inserting and securing in the tool mandrels of selected length and (2) adjusting the mandrel holder axially in the puller means to in turn vary the position of the rivet nut carrying mandrel with respect to the anvil.

3. The tool of claim 2 in which the puller means and the mandrel holder are engaged through left hand threads such that counterclockwise rotation of the mandrel holder causes it to move axially further into the puller means and in which the upper stem portion of the mandrel and the mandrel holder are engaged with right hand threads.

4. The tool of claim 2 in which the puller means and the mandrel holder are engaged through right hand threads such that clockwise rotation of the mandrel holder causes it to move axially further into the puller means and in which the upper stem portion of the mandrel and the mandrel holder are engaged with right hand threads.

5. The tool of claim 2 in which the mandrel holder is threadedly adjustable toward the housing to bring the handles closer together so that during the setting stroke the reciprocating movement of the puller means is less than its full range.

6. The tool of claim 2 in which the anvil is integrally formed in the housing.

7. The tool of claim 2 in which the anvil is detachable from the housing.

8. The tool of claim 2 in which the anvil is a ring means slidably mounted on the mandrel in a position so that the ring means is urged against the housing during setting of the rivet nut.

9. The tool of claim 2 in which the lower threaded stem portion of the mandrel including thread means for receiving and holding the stem of a rivet bolt.

10. The tool of claim 2 in which a plurality of mandrels are used having different lengths and differing lower stem diameters to accommodate differing sizes and types of head-deformable fasteners.

11. A method of setting a plurality of types of head-deformable fasteners using a cavity-containing tool having handles which are squeezed together by hand to pull and deform the fastener head against an anvil on the tool comprising (a) selecting a head-deformable fastener to set;

(b) placing a puller unit in the tool cavity adapted to pull the selected fastener; one puller unit having an internal threaded bore with a mandrel holder threadedly engageable therein; said mandrel holder in turn adapted to receive one of a plurality of mandrels to pull one of a plurality of types and sizes of rivet nuts and rivet bolts; a second insertable puller unit adapted to pull blind rivets;

(c) moving the handles toward one another to set the fastener.

12. A method of setting a head deformable rivet nut fastener using a tool having handles which are squeezed to move a slidable puller including a mandrel to deform the fastener on an anvil on the tool in which the position of the handles of the setting tool are predetermined prior to the setting stroke comprising (a) moving the handles towards one another to cause the puller to slide and holding the handles in a closed position;

(b) substituting one of a plurality of anvils of differing lengths to predetermine the stroke;

(c) adjusting the distance the mandrel extends from the tool until the rivet nut is against the anvil;

(d) opening the handles to create a space between the fastener and the anvil; and (e) thereafter adjusting the mandrel to again bring the fastener against the anvil, and thereafter setting said rivet nut.

* * * * *